US006116455A

United States Patent [19]

Rossman et al.

[11] Patent Number: 6,116,455

[45] Date of Patent: Sep. 12, 2000

[54] DISPENSING CONTAINER

[75] Inventors: Jon R. Rossman, Chelmsford; Bryan R. Hotaling, Arlington, both of Mass.

[73] Assignee: The First Yeras Inc., Mission Viejo, Calif.

[21] Appl. No.: 09/121,001

[22] Filed: Jul. 22, 1998

[51] Int. Cl.[7] ..... B65D 25/18

[52] U.S. Cl. ..... 220/575; 220/23.83

[58] Field of Search ..... 220/575, 574, 220/556, 23.83, 23.86, 23.87, 23.88, 23.89, 23.9, 23.91, 507, 506, 505, 501, 526, 524, 528, 529, 574.3, 475, 254, 817, 822, 826, 915.1, 737, 740; 206/514

[56] References Cited

U.S. PATENT DOCUMENTS

| | | | |
|---|---|---|---|
| 135,296 | 1/1873 | Thurston et al. | 220/23.83 |
| 672,820 | 4/1901 | Brooks | 220/23.83 |
| 1,531,358 | 3/1925 | Thompson et al. | 220/529 |
| 3,720,346 | 3/1973 | Cypher | 220/533 |
| 3,983,993 | 10/1976 | Hsu | 206/1.7 |
| 4,543,978 | 10/1985 | Laverman et al. | 137/255 |
| 4,993,584 | 2/1991 | Macario | 220/523 |
| 5,564,362 | 10/1996 | Fiveash | 119/51.5 |
| 5,799,787 | 9/1998 | Talbot | 206/315.11 |
| 5,868,266 | 2/1999 | Nobakht | 220/23.86 |

OTHER PUBLICATIONS

Pecoware, "Cereals On The Go", Product No. 00852.

Pepperidge Farm, Inc., "Goldfish Snack Container", Product No. 60010, © 1997.

General Mill's, Inc., Cheerios®, "Tot Container", Product No. 72201, © 1992.

*Primary Examiner*—Stephen Castellano

*Attorney, Agent, or Firm*—Fish & Richardson P.C.

[57] ABSTRACT

The invention provides an apparatus comprising a container having a bottom wall and a side wall extending upwardly therefrom to define a first chamber that is rotationally symmetric about an axis throughout a major portion of its perimeter and a second chamber in communication with the first chamber, a divider rotatably receivable by the first chamber and having a shaft and a plurality of fins extending from the shaft toward an inner surface of the side wall, a first-chamber cover adapted to be received by a top edge of the container side wall to provide an upper surface for the first chamber and defining a hole for rotatably receiving the shaft.

8 Claims, 5 Drawing Sheets

DISPENSING CONTAINER

BACKGROUND OF THE INVENTION

This invention relates to a container for storing and dispensing items, e.g., snack foods.

A variety of containers exist for storing items such as food. These containers can be used for, e.g., conveniently packaging and storing food in a refrigerator or freezer, or for keeping food fresh. These containers can also be used to safely transport food items for consumption at a later time. For example, children might use such containers for storing and transporting lunch foods or snacks to school, where they could remove and consume the contents.

SUMMARY OF THE INVENTION

In general, in one aspect, the invention provides an apparatus comprising a container having a bottom wall and a side wall extending upwardly therefrom to define a first chamber that is rotationally symmetric about an axis throughout a major portion of its perimeter and a second chamber in communication with the first chamber, a divider rotatably receivable by the first chamber and having a shaft and a plurality of fins extending from the shaft toward an inner surface of the side wall, a first-chamber cover adapted to be received by a top edge of the container side wall to provide an upper surface for the first chamber and defining a hole for rotatably receiving the shaft.

Implementations of the invention may include one or more of the following. The first-chamber cover can be removable from the cup. The divider can comprise a frustoconical base. The shaft, base, and fins of the divider can be integrally formed. The shaft can comprise a hollow tube, and the apparatus can further comprise a cap receivable by a top of the shaft to provide a closed end for the tube. The cap can comprise an end wall and a side wall depending therefrom defining a cavity for receiving the top of the shaft, the end wall comprising a lid pivotable between an open position for providing access to an interior of the shaft and a closed position for restricting access to the interior of the shaft. A second-chamber cover can be hingedly attached to the first-chamber cover and adapted to be received by the top edge of the container side wall to provide an upper surface for the second chamber.

In general, in another aspect, the invention provides a dispensing apparatus comprising a cup having a bottom wall and a side wall extending upwardly from the bottom wall to define a first chamber, in a first portion of the cup, that is rotationally symmetric about an axis and a second chamber, in a second portion of the cup, contiguous with and radially extending from the first chamber, a carousel rotatably received by the cup in the first chamber and including a frustoconical base, a hollow shaft extending from a top of the base along the axis and defining a third chamber, and a plurality of fins radially extending from the shaft toward an inner surface of the side wall of the first chamber, a cap received by the hollow shaft and defining a cap hole in communication with the third chamber, the cap including a pivotable lid adapted to inhibit access to the cap hole when in a closed position and to allow access to the cap hole when in an open position, a first-chamber cover receivable by a top of the first portion of the cup and defining a cover hole for receiving the cap, and a second-chamber cover hingedly coupled to the first-chamber cover and receivable by a top of the second portion of the cup.

Embodiments of the invention may provide one or more of the following advantages. Items can be stored in a convenient container and selectively dispensed into a portion of the container that allows easy access to the dispensed contents. Items can be stored separately. Stored items can be dispensed by being rotated and can be accessed by lifting one or more covers or lifting a lid. Liquid and dry items can be stored without mixing with each other. Risk of loss of stored items due to spillage can be reduced. Other advantages will become clear from the following description, and from the claims.

DESCRIPTION OF PREFERRED EMBODIMENTS

Figure 1:
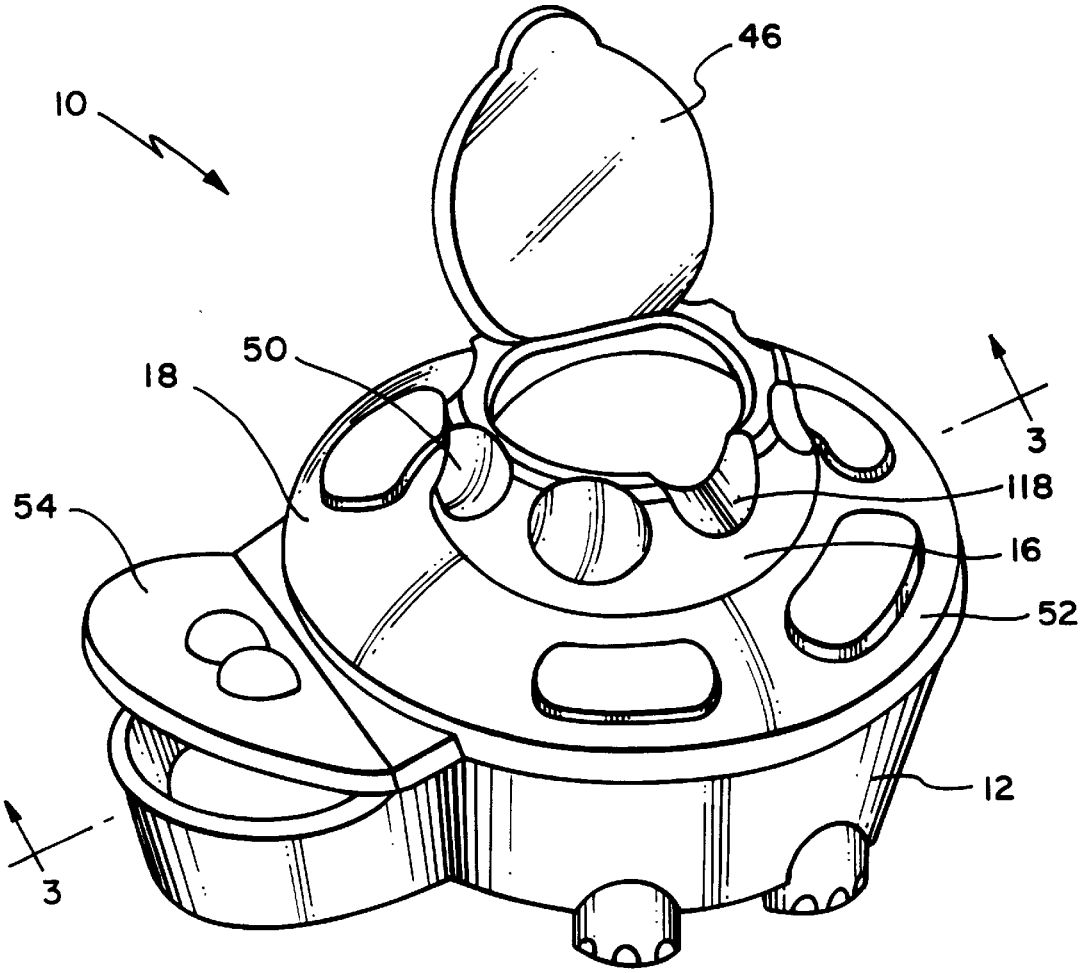
FIG. 1 is a perspective view of an assembled snack dispenser.
Figure 2:
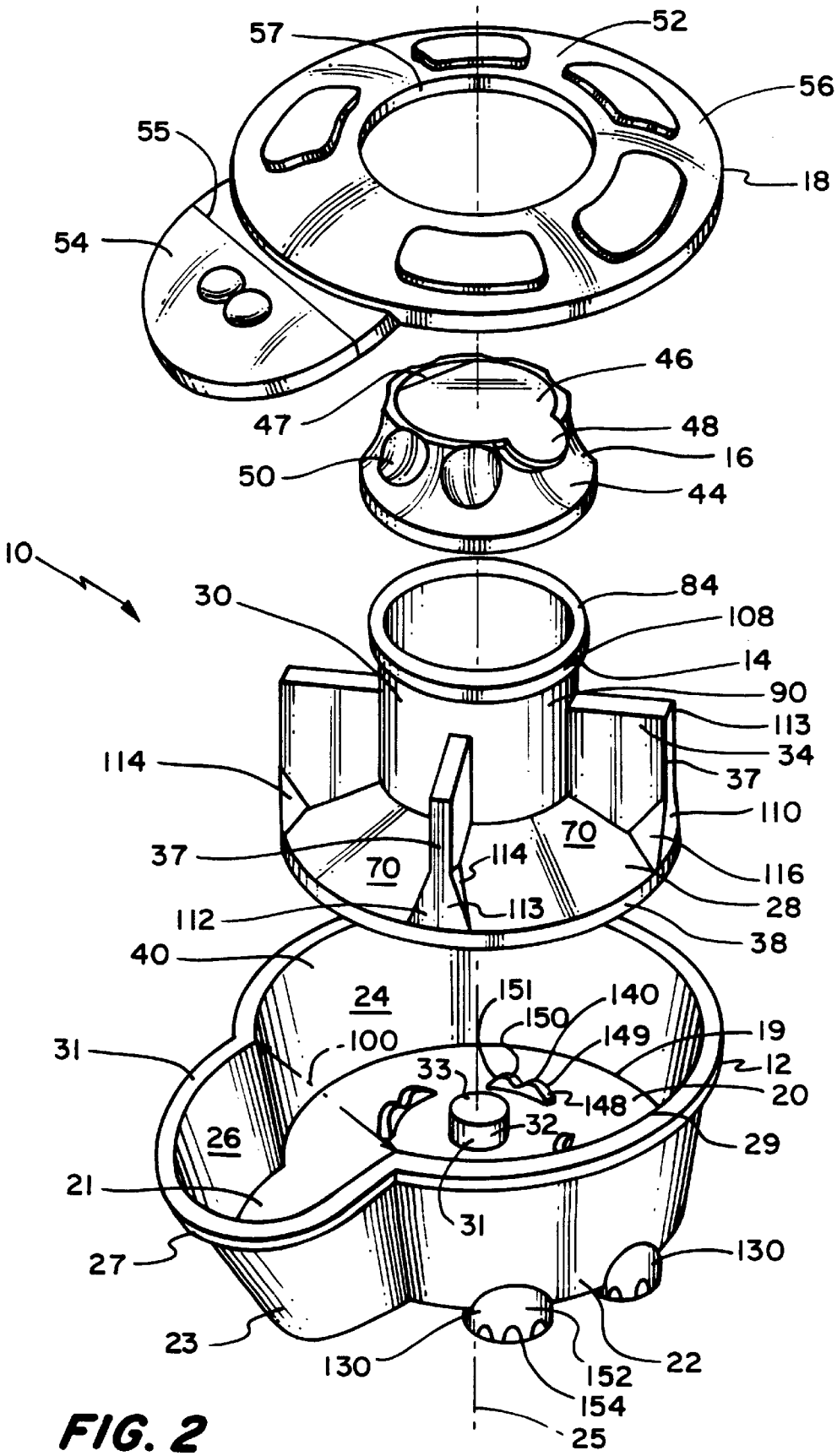
FIG. 2 is an exploded view of the snack dispenser of FIG. 1.

As shown in FIGS. 1 and 2, a snack dispenser 10 includes a cup 12, a divider or carousel 14, a cap 16, and a cover 18. Dispenser 10 can be configured to store and dispense items of various sizes. Here, dispenser 10 is made of polypropylene and is configured to store and dispense food, such as cereal or crackers, and to be held and used by a child. Container 10 can be made to have an appealing appearance, e.g., as shown here to resemble a turtle.

Cup 12 includes bottom walls 20 and 21 and side walls 22 and 23 extending upward from bottom walls 20 and 21 respectively. Bottom wall 20 and side wall 22 together define a first chamber 24. Side wall 22 is frustoconically shaped, extending upward and outward from bottom wall 20 at a slight angle, e.g., about 3°, and defines a port 100. First chamber 24 is thus conically shaped, albeit not fully enclosed by side wall 22, and centered about an axis 25. The circumference or perimeter of chamber 24 at a bottom edge 19 abutting bottom wall 20 is smaller than the circumference at a top edge 29 of side wall 22. First chamber 24 is rotationally symmetric about axis 25 throughout most of its perimeter (i.e., side wall 22 is displaced a constant radial distance from axis 25 for a selected height along axis 25).

Bottom wall 21 and side wall 23 define a second chamber 26 in communication with first chamber 24 through port 100. A top edge 31 of side wall 23 slopes downwardly from top edge 29. Bottom wall 21 slopes downwardly from bottom wall 20. Side walls 22 and 23 have an outwardly extending bead or rib 27 disposed about their perimeters near top edges 29 and 31.

Figure 3:
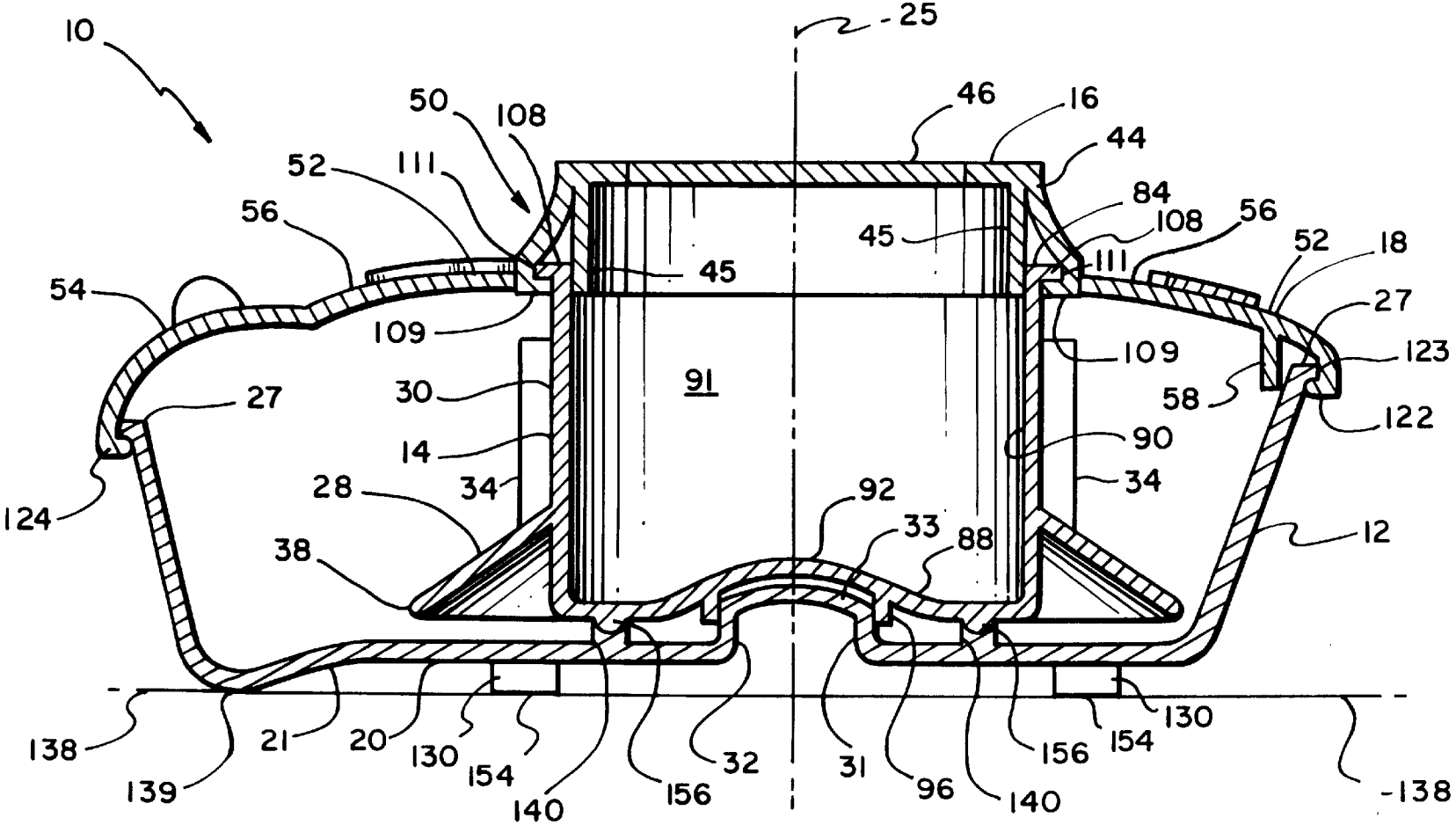
FIG. 3 is a partially schematic cross-sectional view of the assembled snack dispenser of FIG. 1 taken along line 3–3.

As shown in FIGS. 2 and 3, cup 12 also includes four feet 130 (two of which are shown in FIGS. 1 and 2, with the other two shown in FIG. 3) depending from side wall 22 and bottom wall 20. The angle at which side wall 22 extends outwardly from bottom wall 20 is exaggerated in FIG. 3. Each foot 130 includes a flat bottom edge 154 that lies in a plane 138 parallel to, and disposed below, bottom wall 20 and level with an end point 139 of bottom wall 21. Each foot 130 also includes a substantially cylindrical side wall 152 shaped to look like a turtle's foot.

Extending upward from bottom wall 20 are a boss 31 and four arcuate ramps 140. Boss 31 has a cylindrical side wall 32 centered along axis 25 and a domed end wall 33. Ramps 140 are equally spaced about axis 25. Each ramp 140 includes a generally M-shaped top surface 148 defining a detent 150 disposed between two sides 149 and 151 that slope sharply downward to form detent 150 and slope gradually downward to provide a smooth transition to bottom wall 20.

Carousel 14 has a frustoconical base 28, a hollow shaft or tube 30 adapted to fit over boss 31 and to be selectively received by detents 150 of ramps 140, and four fins 34, all integrally formed.

Shaft 30 includes a side wall 90, an end wall 88, and a cylinder 96 and four knobs 156 (only two are shown in FIG. 3) depending from end wall 88. Side wall 90 is cylindrically shaped and extends upward from end wall 88 to define a third chamber 91. Side wall 90 has an outwardly extending bead or rib 108 disposed about the perimeter of side wall 90 near a top edge 84. End wall 88 is flat away from axis 25 and is curved near axis 25, forming a dome 92 extending upward within shaft 30. Dome 92 is shaped to mate with, and rotatably rest on top of, boss 31. Cylinder 96 is centered along axis 25, extends downward from end wall 88, and is sized to receive boss 31 with little clearance between the inner diameter of cylinder 96 and the outer diameter of boss 31. Cylinder 96 helps to align carousel 14 within cup 12 along axis 25. Knobs 156 are spaced about axis 25 and configured to be received by detents 150 in ramps 140. Knobs 156 are disposed with respect to ramps 140 such that when knobs 156 are received by detents 150, carousel 14 is oriented within cup 12 as shown in FIG. 4, with one of four regions 70 defined between fins 34 being centered about port 100 and in communication with second chamber 26.

Frustoconical base 28 is configured to be rotatably received by cup 12. Base 28 extends radially outward and downward from shaft 30 such that when carousel 14 is received by cup 12, an outer end 38 of base 28 slidably contacts, or is disposed in close proximity to, bottom wall 20 and slidably contacts, or is disposed closely within, side wall 22.

Figure 4:
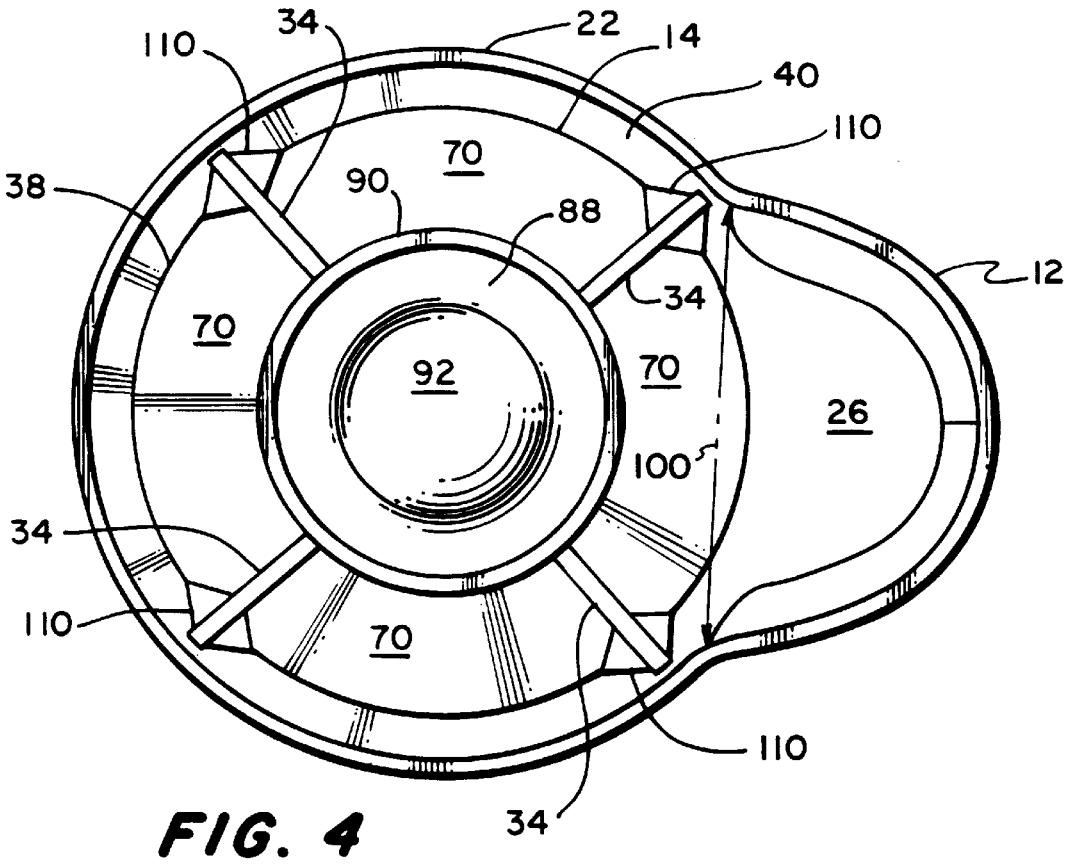
FIG. 4 is a top view of a cup and a divider of the snack dispenser of FIG. 1.

As shown in FIGS. 2 and 4, fins 34 are integrally formed with shaft 30 and base 28 and include plows 110. Fins 34 extend radially outward from shaft 30 along the top of base 28 to an edge 37, defining regions 70 between fins 34. Edge 37 extends upward from end 38 of base 28 toward shaft 30 at a slight angle, e.g., about 1°. Edge 37 is also configured to slidably engage an inner surface 40 of cup 12. Near edge 37, each fin 34 includes a plow 110. Plow 110 includes a substantially triangular end surface 112 and two substantially triangular side surfaces 114 and 116. End surface 112 is continuous with edge 37, has a similar arcuate curvature to the conical shape of side wall 22 of cup 12, and extends from a tip 113 to the top of frustoconical base 28. End surface 112 widens as it extends from tip 113 to the top of base 28. Side walls 114 and 116 extend from end surface 112 toward shaft 34 along the top of base 28 to each side of fin 34.

Returning to FIGS. 2 and 3, cap 16 is configured to securely fit onto shaft 30 and includes an outer wall 44, an inner wall 45, and a lid 46. Outer wall 44 includes several, here seven, notches 50 each shaped to receive a fingertip, and a channel 118 (FIG. 1). Outer wall 44 also includes a radially inwardly directed lip 109 that has an inner diameter that is smaller than an outer diameter of rib 108, and that forms a recess 111 for nonrotatably receiving rib 108. Preferably, the overlap of rib 108 and lip 109 is enough that once rib 108 is received by recess 111, it is difficult to remove cap 16 from shaft 30, especially for a child. Inner wall 45 extends downward from outer wall 44, forming a cylinder that fits within an upper end of shaft 30. Lid 46 includes a tab 48 and is hingedly attached to outer wall 44 at a hinge 47 between an open position, shown in FIG. 1, and a closed position, shown in FIG. 3. When closed, lid 46 provides an end wall for the cylinder formed by inner wall 45, and tab 48 extends through channel 118 to about the outer diameter of outer wall 44. When lid 46 is open, third chamber 91 communicates through cap 16 to the exterior of dispenser 10.

Cover 18 includes a first-chamber cover 52 integrally formed with a second-chamber cover 54. Chamber covers 52 and 54 are hingedly attached at hinge 55. First-chamber cover 52 has a generally dome-shaped top wall 56 and a skirt 58 extending downward from top wall 56. Top wall 56 defines a hole 57 configured to rotatably receive cap 16. Top wall 56 also includes a radially inwardly directed lip 122 having an inner diameter that is smaller than an outer diameter of rib 27 extending from side wall 22 of cup 12. Thus, top wall 56 forms a recess 123 for releasably receiving rib 27. Second-chamber cover 54 includes an inwardly directed lip 124 configured to releasably engage and underlie rib 27 when second-chamber cover is received by side wall 23. Preferably, the fit between cover 18 and rib 27 is such that cover 18 can retain items within dispenser 10, yet be easily removed from cup 12 upon exertion of an upward force on the outer edge of cover 18.

The components of dispenser 10 are molded of plastic in a conventional manner. Dispenser 10 can be assembled as follows. Referring to FIG. 2, carousel 14 is inserted into cup 12 so that dome 92 and cylinder 96 are rotatably received by boss 31. Carousel 14 thus serves as a divider, dividing first chamber 24 into four compartments 70 (FIG. 4) defined by fins 34, shaft 30, and side wall 22, with one compartment 70 in communication with second chamber 26 through port 100. Cap 16 is fit onto carousel 14, with inner cylindrical wall 45 being received by shaft 30 and lip 109 being forced past rib 108, snapping cap 16 onto shaft 30. Cover 18 is snapped onto cup 12, with hole 57 receiving cap 16 and lips 122 and 124 being forced past rib 27.

In use, dispenser 10 provides a convenient container for carrying, storing, and dispensing items. A user removes cover 18 from cup 12 by lifting cover 18 to force lips 122 and 124 over rib 27, and fills compartments 70 with items (e.g., cereal). Second chamber 26 may also be filled directly or by filling the compartment(s) 70 in communication with second chamber 26. The user snaps cover 18 onto cup 12 over first and second chambers 24 and 26. Lid 46 is opened by lifting tab 48, additional items, e.g., crackers, are placed within shaft 30, and lid 46 is closed.

Contents can be removed from dispenser 10 is a variety of ways. The user can remove items from shaft 30 by opening lid 46 and withdrawing contents as desired. The user can remove contents from compartments 70 by grasping and rotating cap 16 about axis 25. As cap 16 is rotated, carousel 14 rotates and knobs 156 slide along bottom wall 20, ride up on ramps 140, and are received by detents 150. As each compartment 70 is rotated into communication with second chamber 26, knobs 156 are received by detents 150 and the contents of compartment 70 slide or spill down the slopes of frustoconical base 28 and bottom wall 21 into chamber 26. Second-chamber cover 54 is opened by lifting up on cover 54 to force lip 124 over rib 27 and cover 54 to rotate about hinge 55, and the contents of second chamber 26 are removed. This process can be repeated to access the contents of the other three compartments 70. Alternatively, the user can remove cover 18 to access the contents of compartments 70.

Other embodiments are within the scope of the invention. For example, dispenser 10 could have a plain appearance or could resemble other animals or things, animate or inanimate, real or fictional.

Figure 5:
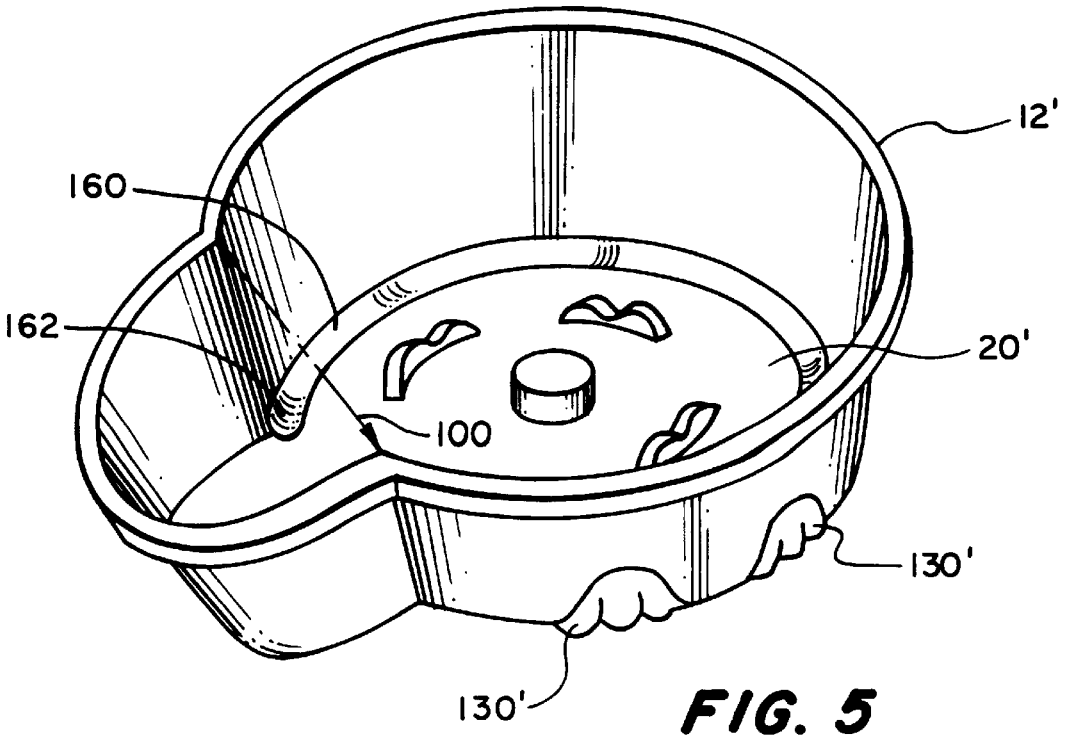
FIG. 5 is a perspective view of another cup.
Figure 6:
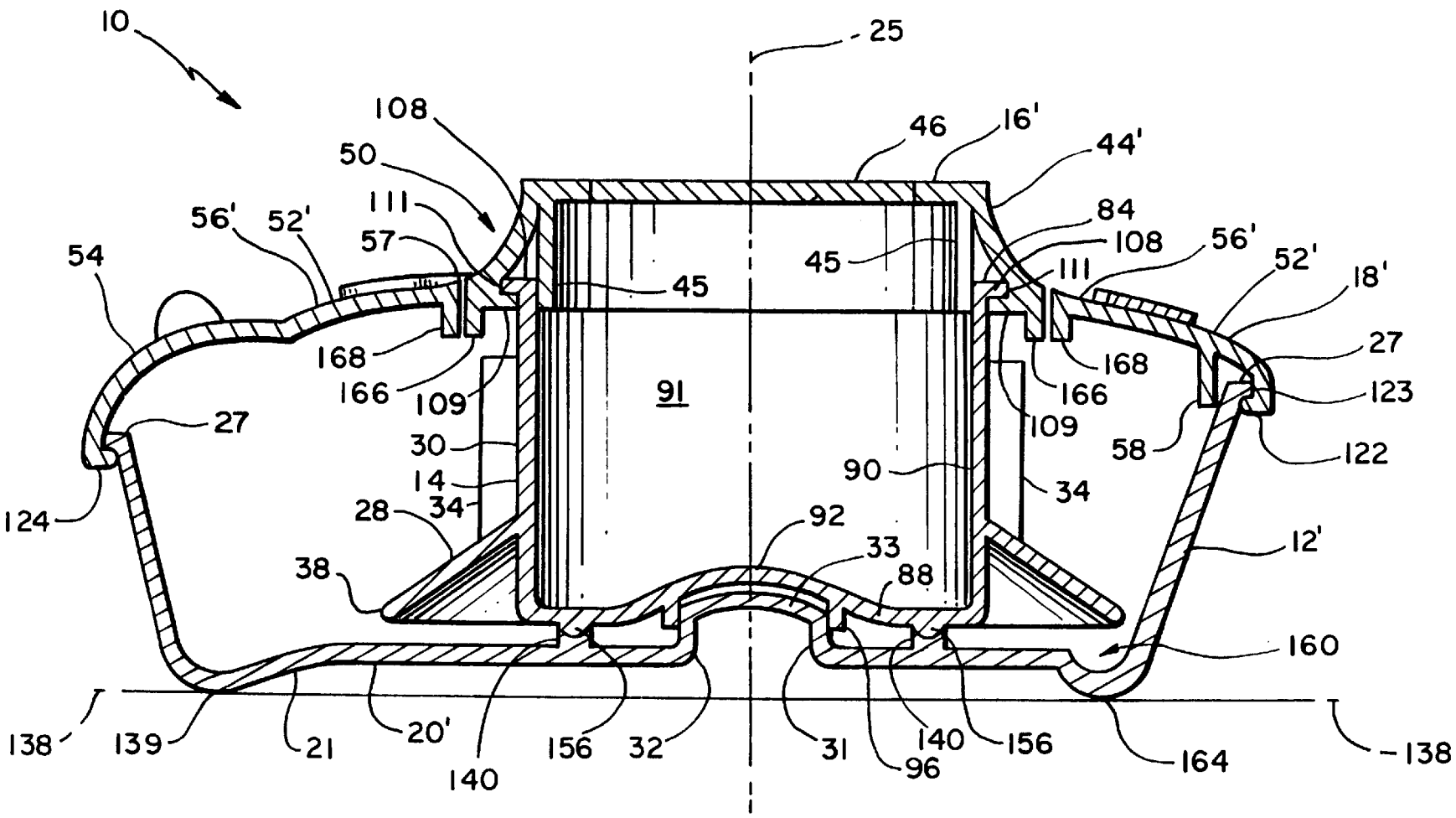
FIG. 6 is a partially schematic cross-sectional view of an assembled snack dispenser.

As shown in FIGS. 5 and 6, with reference to FIG. 3, a cup 12' may be substituted for cup 12, a cap 16' substituted for cap 16, and a cover 18' substituted for cover 18. Cup 12' is substantially similar to cup 12 and cover 18' is substantially similar to cover 18'. Cup 12', however, includes a half-cylinder shaped trough 160 at the outer edge of bottom wall 20' except across port 100, at which point trough 160 ends abruptly, yet smoothly in a short, curved surface 162. A bottom point 164 of bottom wall 20' under trough 160 is disposed in plane 138 with end point 139. Feet 130' do not extend underneath bottom wall 20' inwardly of bottom point 164.

Cap 16' is similar to cap 16 and cover 18' is similar to cover 18. Outer wall 44' of cap 16', however, includes a flange 166 extending downwardly at an outside edge. A top wall 56' of first-chamber cover 52' of cover 18' is similar to top wall 56 except that top wall 56' includes a downwardly directed flange 168 disposed about hole 57. Flanges 166 and 168 are adapted to slidably engage.

What is claimed is:

1. An apparatus comprising:

a container having a bottom wall and a side wall extending upwardly therefrom to define a first chamber that is rotationally symmetric about an axis throughout a major portion of its perimeter and a second chamber in communication with the first chamber;

a divider rotatably receivable by the first chamber and having a shaft and a plurality of fins extending from the shaft toward an inner surface of the side wall;

a first-chamber cover adapted to be received by a top edge of the container side wall to provide an upper surface for the first chamber and defining a hole for rotatably receiving the shaft.

2. The apparatus of claim 1 wherein the first-chamber cover is removable from the cup.

3. The apparatus of claim 1 wherein the divider further comprises a frustoconical base.

4. The apparatus of claim 3 wherein the shaft, base, and fins of the divider are integrally formed.

5. The apparatus of claim 1 wherein the shaft comprises a hollow tube, the apparatus further comprising a cap receivable by a top of the shaft to provide a closed end for the tube.

6. The apparatus of claim 5 wherein the cap comprises an end wall and a side wall depending therefrom defining a cavity for receiving the top of the shaft, the end wall comprising a lid pivotable between an open position for providing access to an interior of the shaft and a closed position for restricting access to the interior of the shaft.

7. The apparatus of claim 1 further comprising a second-chamber cover hingedly attached to the first-chamber cover and adapted to be received by the top edge of the container side wall to provide an upper surface for the second chamber.

8. A dispensing apparatus comprising:

a cup having a bottom wall and a side wall extending upwardly from the bottom wall to define a first chamber, in a first portion of the cup, that is rotationally symmetric about an axis and a second chamber, in a second portion of the cup, contiguous with and radially extending from the first chamber;

a carousel rotatably received by the cup in the first chamber and including a frustoconical base, a hollow shaft extending from a top of the base along the axis and defining a third chamber, and a plurality of fins radially extending from the shaft toward an inner surface of the side wall of the first chamber;

a cap received by the hollow shaft and defining a cap hole in communication with the third chamber, the cap including a pivotable lid adapted to inhibit access to the cap hole when in a closed position and to allow access to the cap hole when in an open position;

a first-chamber cover receivable by a top of the first portion of the cup and defining a cover hole for receiving the cap; and a second-chamber cover hingedly coupled to the first-chamber cover and receivable by a top of the second portion of the cup.

* * * * *